US008490696B2

(12) United States Patent
Smith

(10) Patent No.: US 8,490,696 B2
(45) Date of Patent: Jul. 23, 2013

(54) METHOD AND APPARATUS TO ENHANCE OIL RECOVERY IN WELLS

(76) Inventor: David Randolph Smith, Kilgore, TX (US)

( * ) Notice: Subject to any disclaimer, the term of this patent is extended or adjusted under 35 U.S.C. 154(b) by 243 days.

(21) Appl. No.: 12/763,650

(22) Filed: Apr. 20, 2010

(65) Prior Publication Data

US 2010/0276146 A1 Nov. 4, 2010

Related U.S. Application Data

(60) Provisional application No. 61/170,966, filed on Apr. 20, 2009.

(51) Int. Cl.
*E21B 43/24* (2006.01)
*E21B 43/16* (2006.01)

(52) U.S. Cl.
USPC ..... 166/272.1; 166/90.1; 166/272.6; 166/305.1

(58) Field of Classification Search
None
See application file for complete search history.

(56) References Cited

U.S. PATENT DOCUMENTS 3,759,329 A 9/1973 Ross
3,822,747 A 7/1974 Maguire, Jr.
4,495,993 A 1/1985 Andersen
4,579,176 A 4/1986 Davies et al.
5,027,896 A 7/1991 Anderson
5,653,287 A 8/1997 Wilson et al.
6,517,286 B1 2/2003 Latchem
2003/0051875 A1 3/2003 Wilson
2006/0065400 A1 3/2006 Smith
2007/0079617 A1 4/2007 Farmer et al.
2008/0065363 A1 3/2008 Middya
2008/0066918 A1 3/2008 Smith

OTHER PUBLICATIONS

Notification concerning transmittal of International Preliminary Report on Patentability, PCT/US2010/031734, Nov. 3, 2011, 13 pages.

International Search Report issued Nov. 18, 2010 during prosecution of International Application No. PCT/US10/31734.

Written Opinion issued Nov. 18, 2010 during prosecution of International Application No. PCT/US10/31734.

*Primary Examiner* — Zakiya W Bates
(74) *Attorney, Agent, or Firm* — Fulbright & Jaworski LLP

(57) ABSTRACT

A method and apparatus for the enhanced recovery of hydrocarbon fluids from subterranean reservoirs using cryogenic fluids. Using the Earth's geothermal energy to warm cryogenic flood fluids injected into subterranean reservoirs, the pressure within the subterranean reservoir is increased. This rise in pressure due to the injection of the cryogenic fluid leads to the production of fluids from to the subterranean reservoirs.

30 Claims, 2 Drawing Sheets

METHOD AND APPARATUS TO ENHANCE OIL RECOVERY IN WELLS

CROSS-REFERENCE TO RELATED APPLICATIONS

This Application claims the benefit of U.S. Provisional Application No. 61/170,966 filed on Apr. 20, 2009, which is incorporated herein in its entirety.

TECHNICAL FIELD

The present invention provides a method for enhanced oil recovery using cryogenic fluids. In particular, cryogenic fluids are injected into subterranean reservoirs to enhance the recovery of oil.

BACKGROUND OF THE INVENTION

In recent years, the demand for oil and natural gas has increased. The increase in demand for oil and natural gas is driving the oil and gas industry to produce more oil and natural gas using more cost efficient and effective techniques. Extracting subterranean fluids from depleted oil and gas reservoirs with new means is needed.

Generally, when extracting oil and natural gas from subterranean reservoirs, the skilled artisan must consider the properties of the reservoir, the types of fluids present in the reservoir, and the physical and chemical properties of fluids of the reservoir. Another important factor in enhancing the total recoverable reserves of hydrocarbons and other fluids form depleted reservoirs is related to the reservoir pressure of the fluids trapped in the reservoir. When a wellbore penetrates a reservoir, the reservoir pressure forces the subterranean fluids out of the reservoir into the wellbore and up ward toward the surface as a function of lower pressure at the surface. As fluids flow into the wellbore, the pressure of the reservoir decreases, or as commonly referred to in the industry the reservoir pressure depletes. As such, over a period of time of extraction, the reservoir pressure becomes insufficient to force hydrocarbon fluids from the reservoir into the well. Therefore, there is a need to maintain and/or increase the reservoir pressure in these depleted reservoirs in order to maximize the percentage of hydrocarbon fluids recovered from the reservoir.

A reservoir's ability to produce oil is also a function of the reservoir's drive mechanism. A reservoir's drive mechanism refers to the forces in the reservoir that displace hydrocarbons out of the reservoir into the wellbore and up to surface. Reservoir drive mechanisms include gas drive (gas cap or solution gas drive), water drive (bottom water drive or edge water drive), combination drive, and gravity drainage. An example of solution gas drive is when soluble gases in the oil expand and are carried into the well with liquid hydrocarbons. Reservoirs where soluble gases form a significant portion of the drive mechanism typically have the lowest reservoir primary recovery factors for hydrocarbons. Therefore, there is a need for a method to continually and rapidly replenish the reservoir energy depleted by the extracted soluble gases. This can be done with the injection of fluids that can energize the reservoir and still more desirable is injecting a fluid that is soluble in the reservoir fluid at reservoir pressure and temperature conditions.

Petroleum engineers often refer to the percentage of oil recoverable from a given reservoir versus the oil in place in a reservoir as the "recovery factor." During primary recovery phase of a wells exploitation, the natural pressure of the reservoir created by the combination of forces like the earths overburden and subsequent compression of the reservoir fluids drives or forces hydrocarbons into the wellbore. However, only about 10 to 30 percent of a reservoir's original hydrocarbons in place are typically produced from the reservoir during the primary recovery phase. After a number of years of producing fluids from reservoirs under primary recovery methods, it becomes necessary to inject fluids from surface into the reservoirs to enhance fluid production from the depleted reservoir. This process is known as Enhanced Oil Recovery (EOR). The purpose of EOR is to increase the recovery of the reservoir fluids.

In general, Enhanced Oil Recovery is divided into two distinct phases, secondary recovery methods and tertiary recovery methods. Secondary recovery methods generally include injecting water or gas to displace oil and driving the hydrocarbon mixture to a production wellbore which results in the enhanced recovery of 20 to 40 percent of the original oil in place. After a reservoir has been flooded with water or other secondary recovery methods, tertiary recovery methods are used to increase the fluid recovery from the reservoir. However in some cases, tertiary recovery methods may be used immediately after the primary recovery method.

Generally, tertiary recovery methods include steam, gas injection, and chemical injection. Steam enhanced tertiary recovery involves injecting steam down an injection well to lower the viscosity of the hydrocarbon fluid. That is, heavy viscous oil reserves is made less viscous to improve their ability to flow out of the reservoir into a well. Gas injection tertiary methods employ gases such as natural gas, nitrogen, or carbon dioxide that expand in a reservoir to push additional oil to a production wellbore. In all these gas injection means, the fluids are at temperatures of more than −100° F. Fluids that are at a temperature below −100° F. are commonly referred to as cryogenic fluids. Preferred gases are those that dissolve in the reservoir hydrocarbon, which lower the in-situ hydrocarbons viscosity and improve the hydrocarbons flow rate from the reservoir to the well bore. Chemical injection involves the use of polymers to increase the effectiveness of water floods, or the use of detergent-like surfactants to reduce the surface tension that often prevents oil droplets from moving through a reservoir.

Generally, carbon dioxide is a common miscible tertiary EOR fluid. Carbon dioxide is the preferred EOR fluid in the current art because it can be delivered to wellbores in a liquid form above cryogenic temperatures. For example, carbon dioxide has a boiling point of −70° F. at ambient pressures, while other gases have a higher boiling point, e.g., methane has a boiling point of −259° F. at ambient pressures. The difference between these boiling points shows that carbon dioxide requires less energy to condense to a liquid phase in comparison to most other fluids that are miscible in hydrocarbon liquids. Nevertheless, over fifty percent of the cost when using carbon dioxide to flood the well is the initial purchase of the carbon dioxide. Further, the use of carbon dioxide in EOR methods has other disadvantages. For example, once carbon dioxide is injected into an injection well, it cannot be recovered and resold. Also, it is a greenhouse gas, the release of which into the atmosphere will likely be regulated. Moreover, it causes formation of carbonic acid in water that can lead to corrosions of pipes and other equipment. What is needed is a tertiary fluid that is soluble in the hydrocarbon fluids, can be commercialized as a part of the reservoir fluid recovery process, and is non-corrosive.

On the other hand, it is plausible for liquid methane or liquid natural gas, LNG, to be used to flood the reservoir in tertiary recovery methods if the liquefied natural gas supply can be replenished continually. When liquid natural gas (LNG) is used as a cryogenic flood fluid to enhance oil recovery, the LNG may be re-gasified under ground and separated from the tertiary recover of oil upon recovery of the combined fluids at the surface. The recovered LNG can be commercialized and sold as natural gas, using the existing equipment already in place to distribute oil and gas from the recovery sites to the market.

Further, it is difficult to inject gases into the reservoir, as it requires large high pressure compressors and prime movers at or near the wellbores. It is costly to construct the required compressor injection facilities at each EOR site, and it is even more cost limiting when the EOR site is offshore because the compressors and prime movers would have to be located on the offshore platforms where space is expensive and limited. This present disclosure provides for a solution where these same gases are liquefied as cryogenic liquids prior to injection to the wells, which allows them to be contained in significantly smaller spaces than their gas counterparts because the same volume of the fluid in liquid form contain several orders of magnitude more molecules than when the fluid is in gas form. For example, cryogenic liquefied methane and LNG contains 600 times more methane than an equivalent volume of methane gas. Consequently, a more cost effective method is needed to get large volumes of these cryogenic flood fluids delivered to the EOR sites to be injected into the subterranean oil reservoirs as flood fluids.

Further, currently, the oil and gas industry has many known reservoirs of natural gas that are stranded because the reservoirs are geographically located far from a commercial markets. As such, to commercialize the natural gas, large facilities are built at these stranded geographical areas to liquefied the natural gas produced at these sites. The LNG is transferred to large cryogenic tankers to commercialize the LNG and bring it to a market. The commercial activities, e.g., sales, of the produced cryogenic fluid, LNG, is limited in the world today because the markets for such LNG requires costly cryogenic facilities to receive and or re-gasify the cryogenic liquids at the destination market. These receiving stations at the destination market, or re-gasification stations, are expensive and require LNG carrying ships to come into ports and near populated areas to discharge their cryogenic cargo. The regassification facilities are often perceived as a potential health hazard; hence, public support for such facilities is difficult to obtain. What is needed are EOR facilities sufficiently far from population centers with facilities and wells equipped to accept the cryogenic fluid cargos as a flood fluid and to serendipitously commercialize the cryogenic flood fluid from production wells once it has served it's purpose as a reservoir displacement or flood fluid and is naturally geothermally heated, re-gasified and/or separated from the recovered hydrocarbon produced to surface after the LNG is injected into the subterranean environment and used as the flood fluid.

The present invention provides a method for injecting large volumes of cryogenic liquids into subterranean reservoirs as very cold fluids, which are subsequently extracted from the reservoir with hydrocarbon fluids as a means of enhanced hydrocarbon recovery. As the geothermal energy warms the cryogenic flood fluid the fluid expands causing an increase in pressure in the reservoir. Additionally, the present invention provides a method for creating large conductivity paths for the cold fluids to enter into the reservoir matrix. Furthermore, this invention teaches methods to inject the cold fluid into wells by means of expanding tubular slip joints in the well. In addition, the present invention discloses methods of utilizing the existing equipment to commercialize LNG from stranded locations without having to build additional structures to re-gasify the delivered LNG in natural gas form.

BRIEF SUMMARY OF THE INVENTION

The present invention provides methods and apparatus for enhancing the recovery of fluids from subterranean reservoirs using cryogenic flood fluids. In some aspects of the present invention the method for enhancing the recovery of fluids from subterranean reservoirs using a cryogenic flood fluids comprises the steps of providing a source of at least one cryogenic flood fluid, delivering at least one cryogenic flood fluid from the source to at least one wellbore, injecting the cryogenic flood fluid with at least one cryogenic pump through at least one wellbore into at least one subterranean reservoir, warming the cryogenic flood fluid, and transporting reservoir fluids produced from the subterranean reservoir into a storage tank through at least one wellbore. In some cases, the storage tank may be on, near or at the Earth's surface. In other embodiments, the storage tank may be aboard an oil platform, an oil tanker, underground and/or submerged under a body of water. In additional embodiments, the reservoir fluids produced from the subterranean reservoir may feed directly into a pipeline.

In other aspects of the present invention, the cryogenic flood fluid source is a liquid natural gas plant. In some embodiments, the cryogenic flood fluid source is a liquid air plant. In certain embodiments, the cryogenic flood fluid is liquid natural gas. In specific embodiments, the cryogenic flood fluid is liquid oxygen. In alternate embodiments, the cryogenic flood fluid is liquid nitrogen.

In some embodiments, the cryogenic flood fluid source is aboard a ship. In alternate embodiments, the cryogenic flood fluid source is provided by a truck in still other embodiments the cryogenic flood fluid source is a pipeline.

In some aspects of the present invention, the step of injecting the cryogenic flood fluid is performed by at least one cryogenic pump. The cryogenic pumps can be positive displacement pumps fed by low pressure cryogenic centrifugal pumps or a series high rate cryogenic turbo-pumps like the low pressure oxidizer pump and high pressure oxidizer pump used on the Space Shuttle. The high rate attribute of the cryogenic turbo-pumps is useful in rapidly unloading large volumes of LNG from LNG tankers offshore to reduce mooring times of the vessels.

In some cases, the wellbore is located offshore and the subterranean reservoir is an offshore oil reservoir. In other embodiments, the subterranean reservoir is an offshore gas reservoir. In specific embodiments, the subterranean reservoir is an aquifer. In other embodiments, the subterranean reservoir is a coal bed methane deposit, a shale oil deposit, and/or a shale gas deposit.

Additionally, the methods of the present invention may include the step of injecting a cryogenic flood fluid comprising a chemical additive. This chemical additive may be a solid, liquid and/or a gas. In some embodiments, the chemical additive is a solid. In some cases, the chemical additive is a polymer. In some cases, the chemical additive may comprise a tetrahalosilane. In specific examples, the tetrahalosilane is silicon tetrachloride.

Alternatively, the methods of the present invention may include the step of injecting a cryogenic fluid comprising a liquid chemical additive. In some embodiments, the liquid chemical additive is hydrogen peroxide. In yet another embodiment, the chemical additive is a gas.

In some embodiments, the reservoir fluid produced from the subterranean reservoir comprises a liquid. In some cases, this liquid comprises a liquid hydrocarbon. The liquid produced from the reservoir may comprise water and/or gas. In some cases, the gas comprises a hydrocarbon gas and/or steam.

In some embodiments, the step of warming the injected cryogenic fluid is performed by an electrical heater. In other embodiments, the warming step is performed by the geothermal energy of the well and reservoir wherein it is injected. The warming step can also be performed by a seawater heat exchanger, or a surface combustion fired heat exchanger.

In additional embodiments, the methods of the present invention further comprises the step of injecting a non-cryogenic flood fluid through at least one wellbore into at least one subterranean reservoir. In particular embodiments, a wellbore has at least one horizontal section.

The present invention provides for injecting at least one cryogenic flood fluid into a subterranean reservoir. In general, this apparatus has a wellbore extending into a subterranean reservoir, a first conduit that is located within the wellbore, a wellhead coupled to the first conduit, a second conduit is located within the wellbore, and a sealing elastomeric thermal expansion slip joint located near a distal end of the second conduit. In some embodiments, the wellbore extends from the surface into a subterranean reservoir. In some embodiments, the first conduit has a fluid path that extends from a location at or above the earth's surface to at least one subterranean reservoir. In certain embodiments, the wellhead that is coupled to the first conduit is located at or near the earth's surface. Additionally, the second conduit has a fluid path that extends from a location at or above earth's surface to at least one subterranean reservoir and the second conduit coupled to a subterranean reservoir at the earth's surface. In other embodiments, the elastomeric thermal expansion slip joint situated so that it is in contact with the inner diameter of first conduit and the outer diameter of the second conduit.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

As used herein, "surface" refers to locations at or above the surface of the Earth, ice, ocean bottom, river bottom, lake bottom, and/or body of water, such as a lake, river, or ocean.

As used herein, "fluid" refers to substance that continually deforms and/or flows under an applied shear stress. This term includes gases and liquids.

As used herein, "cryogenic" refers to a liquid that boils, i.e., changes from a liquid to a gas, at temperatures less than about 110 Kelvin (K) at atmospheric pressure, such as hydrogen, helium, nitrogen, oxygen, air, or methane (natural gas).

Figure 1:
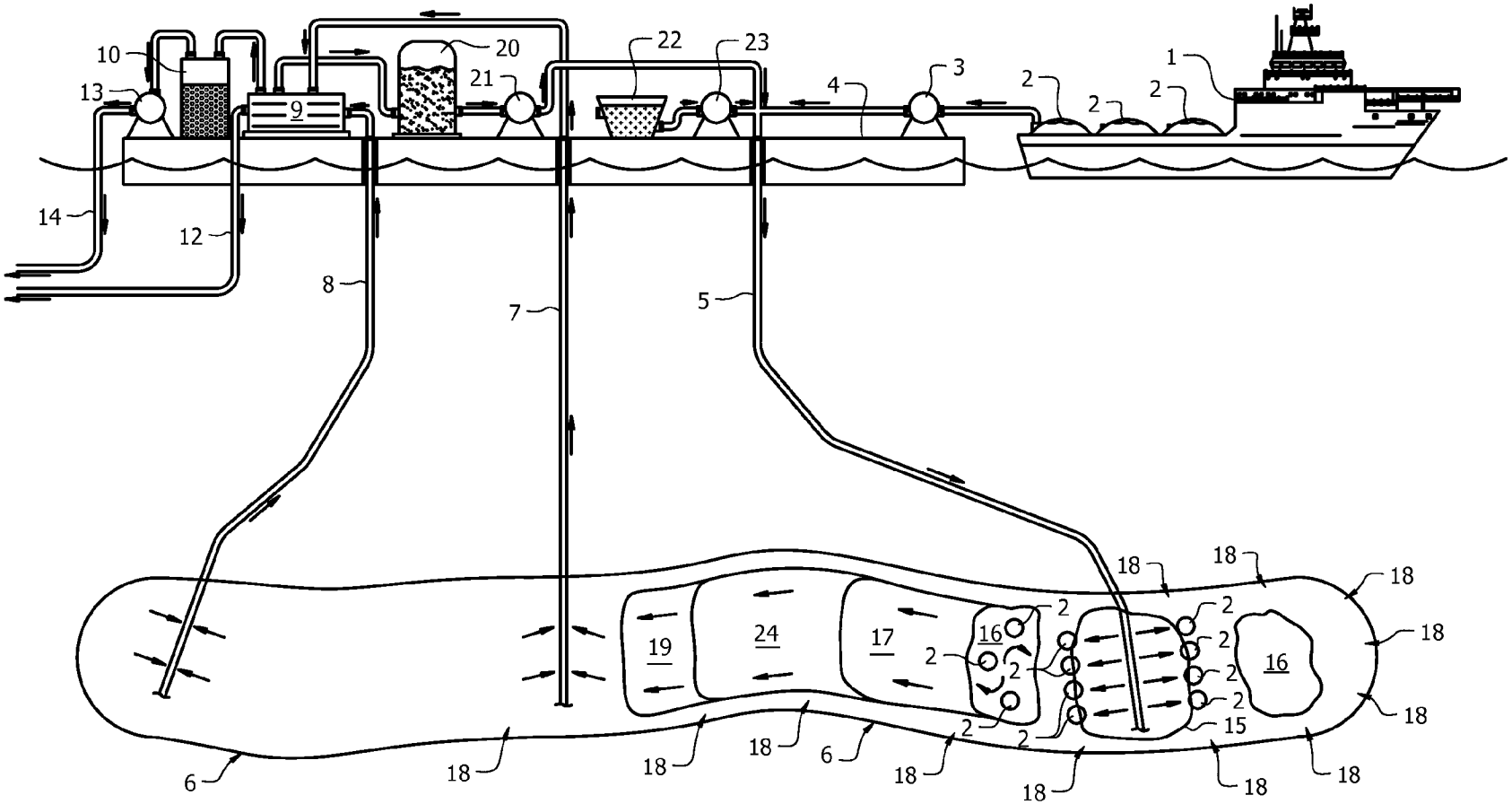
FIG. 1 shows schematic of a system that uses a cryogenic fluid to enhance the recovery of oil from a reservoir.

FIG. 1 shows a schematic of a system that uses a cryogenic fluid to enhance the recovery of oil from a reservoir. In FIG. 1, LNG ship 1 transports liquefied natural gas 2 from a LNG fabrication source to offshore oil platform 4. While FIG. 1 depicts transportation of LNG 2 by ship 1 to offshore platform 4, it is envisioned that other embodiments include transport of LNG 2 by truck to wellbores located on land. This invention also contemplates the construction of a liquid air plant to produce cryogenic fluids near the EOR site or a natural gas liquefaction plant located near the EOR site. As depicted, LNG 2 is transferred from containers aboard LNG ship 1 to pump 3 located on an offshore platform 4. In the preferred embodiment, pump 3 is a large cryogenic turbo-pump system, such as the Rocketdyne low pressure and high pressure oxidizer turbo-pumps used on the main engine of the space shuttle. In other embodiments, however, it is envisioned that other suitable cryogenic pumps as known in the art can be used. The liquid natural gas 2 is injected from pump 3 through wellbore 5. The LNG 2 travels through wellbore 5 into subterranean oil and gas reservoir 6. Wellbores 7 and 8 are located at different positions in subterranean reservoir 6. Oil and natural gas are produced through wellbores 7 and 8. In other embodiments, reservoir 6 can be an aquifer that produces water or a gas reservoir that has a low pressure due to previous depletion.

In FIG. 1, wellbores 7 and 8 direct the produced oil and natural gas to a separator 9 located on the surface of offshore platform 4. Separator 9 is where the oil, gas, and any water are separated. The gas is then transferred through gas pipeline 12 to a site on the shore (not shown). The oil is transferred to oil tank 10 located on offshore platform 4. From oil tank 10, pump 13 directs the oil into oil pipeline 14, which leads the oil from offshore pipeline 4 to a site on the shore (not shown). Any water separated using the separator 9 is transferred to water tank 20 where it can be filtered and then disposed in the sea. In some cases, the recovered water is re-injected into the reservoir 6 using pump 21. Furthermore, the method can use the injection of sea water to be injected intermittently when LNG is not being injected into a well. In some examples, the recovered water or other water, like sea water, is directed down a wellbore 5 and reused as a flood fluid. In some cases, the oil tank and/or storage tank may be on, near or at the Earth's surface. Additionally, oil tank 10 may be aboard an oil platform, an oil tanker, underground and/or submerged under a body of water. In additional examples, the reservoir fluids produced from the subterranean reservoir may feed directly into a pipeline. As discussed above, the present disclosure allows for the EOR injection fluid to be recovered and sold as natural gas using the already existing structures in place that distribute the oil and gas recovered at platform 4, or any other recovery sites. As such, the present invention facilitates the commercialization of LNG at stranded locations and eliminates the need to build additional regasification stations.

In the preferred embodiment, liquid natural gas 2 is injected into subterranean reservoir 6 as a cold liquid. The cold fluid has advantages over previous methods of EOR injection of gases as the cold fluid causes cracking and rubbilizing of the subterranean reservoir thereby exposing a new fluid path for the flood fluids to sweep hydrocarbons from the reservoir. As LNG 2 begins to heat up in the reservoir 6, a flood bank of liquid natural gas 16 is formed near injection points 15 of well bore 5. As the LNG 2 is being injected through wellbore 5, wellbores 7 and 8 draw liquids like oil and gas fluids from the same reservoir 6. As LNG 2 moves through wellbore 5, the flood front pushes toward production wellbores 7 and 8. In other embodiments, other fluids besides LNG like liquid air, nitrogen, and oxygen, can be used as the cryogenic flood fluid. In FIG. 1, as LNG 2 advances away from the injection wellbore 5, liquefied gas 2 is warmed by geothermal energy 18 of the earth. Although geothermal energy is used in this particular example, the cryogenic flood fluids may be warmed by other methods including, but not limited to, the various methods used in thermal recovery, in situ combustion, wet combustion and fire flooding. For example, the injected cryogenic fluid, e.g., LNG 2, can be heated with an electrical heater, a seawater heat exchanger, or a surface combustion fired heat exchanger. This geothermal energy 18 flows into subterranean reservoir 6 and mixes with the fluids of reservoir 6. During injection, geothermal energy 18 mixes with the reservoir fluids and the injection fluids to form a series of flood banks, exemplified by 16, 17, 19, and 24 of vaporizing cryogenic fluid like natural gas 2, reservoir fluids, and injected water. As the liquid natural gas is injected into wellbore 5 and fluids are drawn to the surface from the reservoir 6 through wellbores 7 and 8, another flood bank is formed at 24. As the flood banks 16, 17, 24, and 19 advance in reservoir 6, other fluids in reservoir 6 are driven into the production wellbores 7 and 8, where they are transduced to surface through the wellbores. Prior to the arrival of the actual break through of the injected fluid, a series of flood banks having different fluid phases, and different mixes of fluids comprising injected fluids and reservoir fluids depicted as flood bank 16, 17, 24, and 19 arrive at the production wells 7 and 8.

Additionally, FIG. 1 shows two production wells 7 and 8 and one cryogenic flood fluid injection well 5. A skilled artisan would readily recognize that multiple injection and production wells may be within the spirit and scope of the present invention. Likewise, other variations such as horizontal wells may be placed in the reservoir 6 for both injection and production wells.

Also, the present invention provides the method for stopping and/or restarting the injection of cryogenic fluids, like liquid natural gas 2, into reservoir 6. This is done to allow geothermal energy 18 of the earth to heat the cryogenic flood fluids in-situ and to allow for LNG ship 1 to arrive with a fresh supply of LNG 2. In another aspect of the present invention, liquid natural gas is injected down a different wellbore like 7 when the next cycle of liquid natural gas 2 is injected into reservoir 6.

Additionally, the water from tank 20 or sea water may be injected into reservoir 6 and used as an alternative flood fluid in between the injection cycles of cryogenic fluids. This water may be used in alternating injection cycles, alternating between water and cryogenic flood fluid. These waters may be heated prior to injecting into the reservoir to further assist in the thermal cracking of the reservoir to enhance reservoir conductivity and to heat the injected cryogenic fluids. In an additional embodiment, chemical additives, such as solids, liquids and gases may be added to the cryogenic flood fluid and the water injection cycle and injected into reservoir 6 from the flood fluids from tank 22 through an injection pump 23. The chemical additives may include, but are not limited to polymers, surfactants, corrosion inhibitors, caustics, ammonium carbonate, hydrogen peroxide, sulfuric acid, urea, butanol, N-alkylacrylamides, terpolymers of acrylamide, N-decylacrylamide, and sodium-2-acrylamido-2-methylpropane sulfonate (NaAMPS), sodium acrylate (NaA), sodium-3-acrylamido-3-methylbutanoate (NaAMB), partially hydrolyzed polymer polyacrylamide, polyacylamide, bentonite clay, polydimethyldiallyl ammonium chloride biopolymers, exopolysaccharide produced by Acinetobacter, Xanthan, Wellan, Pseudozan, silicon tetrahalides (halide refers to a halogen atom such as, fluoride, chloride, bromide, iodide and/or astatide), silicon tetrachloride, silicon tetrafluoride, silicon tetrabromide, and/or silicon tetraiodide.

Figure 2:
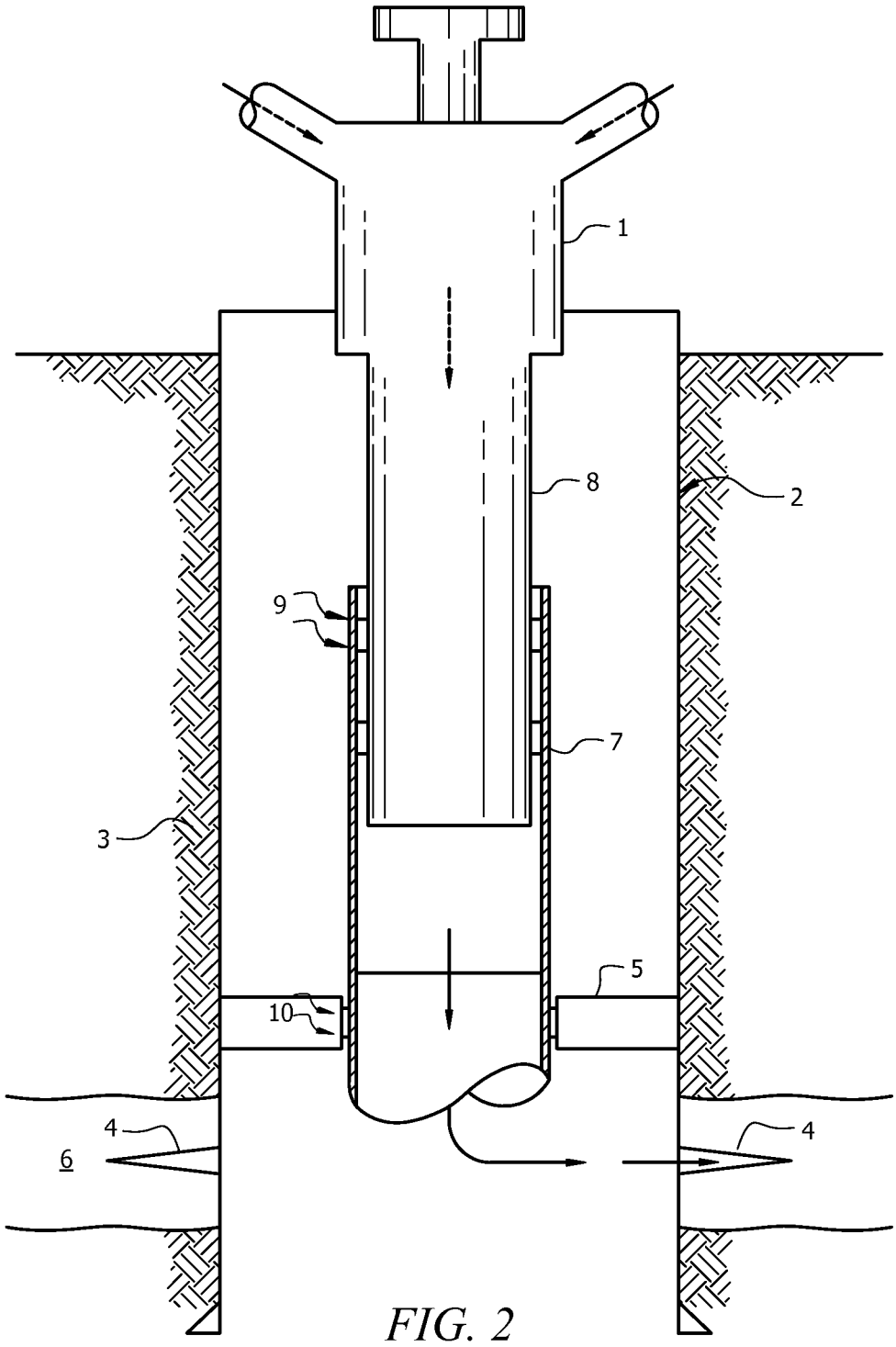
FIG. 2 shows a well apparatus for injecting cryogenic fluids into reservoir.

FIG. 2 shows a wellbore apparatus used to inject the cryogenic flood fluids. The wellbore apparatus shown in FIG. 2 has wellhead 1 connected at the surface to a casing 2, which is disposed in well 3. Casing 2 is set to a depth below subterranean reservoir 6 and has perforations 4 that allow hydraulic communication with reservoir 6. Located in casing 2 above perforations 4 is polished bore receptacle 5, which forms a smooth bore through its internal diameter and accepts seal assembly 7. The seal assembly 7 has outer sealing elements 10 located on its outer diameter such that when seal assembly 7 contracts or expands, the plurality of sealing elements 10 form a moveable sealing means with the inner diameter of polished bore receptacle 5. That is, there is at least one outer sealing element 10 located at any position of contraction or expansion to form a seal between sealing assembly 7 and polished bore receptacle 5. Seal assembly 7 is longer than the length of the polished bore receptacle 5. This allows for seal assembly 7 to contract and expand as tubing 8 is cooled and heated with cryogenic flood fluids and other injection and production fluids thereby forming a moving sealing means with outer sealing elements 10. Likewise, tubing 8 has sealing elements 9 that form a hydraulic seal between the outer diameter of tubing 8 and the inner diameter of seal assembly 7. Sealing elements 9 can be hydraulic slip joints that create a moveable sealing means between seal assembly 7 and tubing 8 that allows tubing 8 to contract and expand inside the seal assembly 7 during the injection of fluids. Sealing elements 9 also form moveable sealing means. That is, there is at least one sealing element 9 located at any position of contraction or expansion to form a seal between the inner diameter of sealing assembly 7 and the outer diameter of tubing 8. As such, the apparatus of FIG. 2 provides great flexibility to accommodate the expansions and contractions in the equipment due to the changes in temperatures of the injection and production fluids.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method to enhance recovery of fluid from at least one subterranean reservoir comprising:

injecting at least one cryogenic fluid through at least a first wellbore into at least one subterranean reservoir;

warming the injected cryogenic fluid, wherein the at least one cryogenic fluid has been pressurized;

extracting fluid of the at least one subterranean reservoir from at least a second wellbore to surface; and transporting the extracted fluid of the at least one subterranean reservoir to a storage tank or sales line, wherein the cryogenic fluid injected through at least the first wellbore displaces the fluid of the at least one reservoir upon extracting the fluid through at least the second wellbore.

2. The method of claim 1, wherein the at least one cryogenic fluid is liquid natural gas.

3. The method of claim 1, wherein the at least one cryogenic fluid is liquid oxygen.

4. The method of claim 1, wherein the at least one cryogenic fluid is liquid nitrogen.

5. The method of claim 1, wherein the injecting is performed by at least one cryogenic pump.

6. The method of claim 1, wherein the injected cryogenic fluid energizes the fluid of the at least one reservoir for said extraction through at least the second wellbore.

7. The method of claim 1, wherein at least one of the first and second wellbores is offshore and the at least one reservoir is an offshore oil reservoir.

8. The method of claim 1, wherein the reservoir is an aquifer.

9. The method of claim 1, wherein the reservoir is a coal bed methane deposit.

10. The method of claim 1, wherein the reservoir is a shale oil deposit.

11. The method of claim 1, wherein the reservoir is a shale gas deposit.

12. The method of claim 1, wherein the reservoir is a oil shale deposit.

13. The method of claim 1, wherein the cryogenic fluid further comprises a chemical additive.

14. The method of claim 13, wherein the chemical additive is selected from the group consisting of a solid, a liquid, and a gas.

15. The method of claim 14, wherein said chemical additive is a solid comprising a tetrahalosilane.

16. The method of claim 15, wherein the tetrahalosilane is silicon tetrachloride.

17. The method of claim 14, wherein the chemical additive is a liquid comprising hydrogen peroxide.

18. The method of claim 1, wherein the reservoir fluid comprises a liquid.

19. The method of claim 18, wherein the liquid from the at least one reservoir further comprises a hydrocarbon liquid.

20. The method of claim 18, wherein the liquid from the at least one reservoir further comprises water.

21. The method of claim 1, wherein the reservoir fluid comprises a gas.

22. The method of claim 21, wherein the gas from the at least one reservoir further comprises a hydrocarbon gas.

23. The method of claim 1, further comprises injecting a non-cryogenic flood fluid through at least one wellbore into the at least one subterranean reservoir where the at least one cryogenic fluid is injected.

24. The method of claim 1 wherein said warming of the injected cryogenic fluid is achieved with at least an electrical heater.

25. The method of claim 1 wherein said warming of the injected cryogenic fluid is achieved with at least geothermal energy of the well and reservoir where the cryogenic fluid is injected.

26. The method of claim 1 wherein said warming of the injected cryogenic fluid is achieved with at least a seawater heat exchanger.

27. The method of claim 1 wherein said warming of the injected cryogenic fluid is achieved with at least a surface combustion fired heat exchanger.

28. An apparatus for injecting at least one cryogenic flood fluid into at least one subterranean reservoir comprising:

at least one cryogenic fluid pump;

at least one wellbore connected from a surface to the at least one subterranean reservoir;

a first conduit located within the at least one wellbore, wherein the first conduit has a first end and a second end and comprises a first fluid path from at least one cryogenic flood fluid source to the at least one subterranean reservoir;

a connection means forming a fluid path between the at least one cryogenic fluid source, the at least one cryogenic pump, and the first conduit located within the at least one wellbore;

a second conduit located within the at least one wellbore, wherein the second conduit has an inner diameter larger than an outer diameter of the first conduit and wherein the second conduit has a first end and a second end, and the first end of the second conduit partially overlaps the second end of the first conduit, wherein the second conduit comprises a second fluid path; and at least one moveable sealing means located near the second end of the second conduit, wherein the sealing means forms at least one hydraulic moveable seal with at least one polished bore receptacle located in the reservoir hydraulically isolating the fluid pressure inside the second conduit and the first conduit.

29. The system of claim 28 wherein said connection means comprises a wellhead.

30. The system of claim 28 further comprising:

a hydraulic slip joint coupled to the first conduit and the second conduit, wherein the hydraulic slip joint is moveable to allow the first conduit to contract and expand as necessary through said hydraulic slip joint.

* * * * *